US005794774A

United States Patent [19]

Porcelli

[11] Patent Number: 5,794,774

[45] Date of Patent: Aug. 18, 1998

[54] DISPOSABLE ORAL HYGIENE APPLICATOR

[76] Inventor: V. Lorenzo Porcelli, Cedar La., Ossining, N.Y. 10562

[21] Appl. No.: 854,320

[22] Filed: May 12, 1997

Related U.S. Application Data

[62] Division of Ser. No. 604,125, Mar. 20, 1996, Pat. No. 5,678,273.

[51] Int. Cl.[6] ..... B65D 85/62

[52] U.S. Cl. ..... 206/369; 206/486

[58] Field of Search ..... 206/361, 362, 206/362.4, 368, 369, 63.5, 531, 532, 461, 469, 486, 488, 489, 823

[56] References Cited

U.S. PATENT DOCUMENTS 4,429,792 2/1984 Machbitz ..... 206/532

4,574,954 3/1986 Reid ..... 206/532 X 5,172,812 12/1992 Wharton et al. ..... 206/532 X

*Primary Examiner*—Jacob K. Ackun

*Attorney, Agent, or Firm*—Michael Ebert

[57] ABSTRACT

A disposable oral hygiene applicator attachable to the ball of a user's fingertip whose finger then functions as an articulated handle by which the applicator may be inserted in the oral cavity and applied omnidirectionally to the teeth and gingival tissues to sweep and clean the teeth and to massage the gums. The applicator includes a circular flexible base dimensioned to cover mainly the round ball of the fingertip, the underside of the base having a layer of pressure-sensitive adhesive thereon. Anchored on the base and projecting upwardly therefrom is a dense array of multi-strand filamentary loops that form the bristles of a miniature brush, a charge of viscous dentifrice being entrapped in the loops. In one preferred embodiment of the applicator, adhering to the layer on the underside of the base is a removable carrier disc whose diameter exceeds that of the base to define a peripheral flange to facilitate removal of the disc so that the applicator may then be adhered to the fingertip.

7 Claims, 4 Drawing Sheets

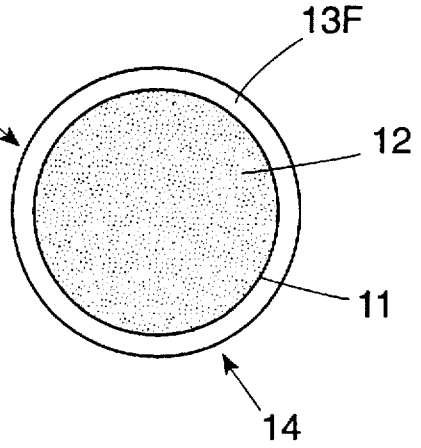
FIG. 1
FIG. 2
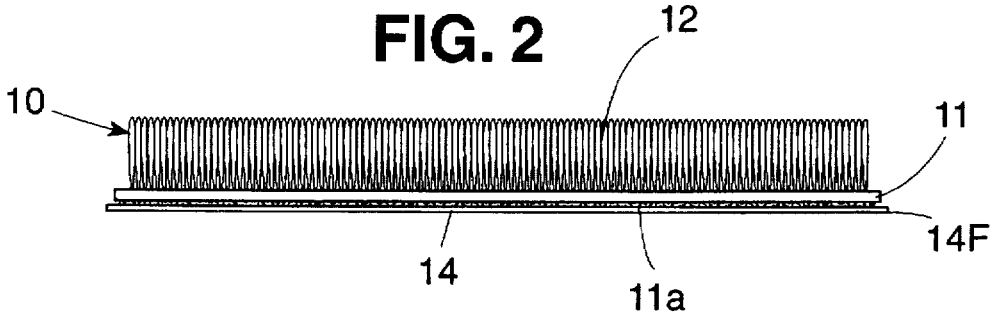
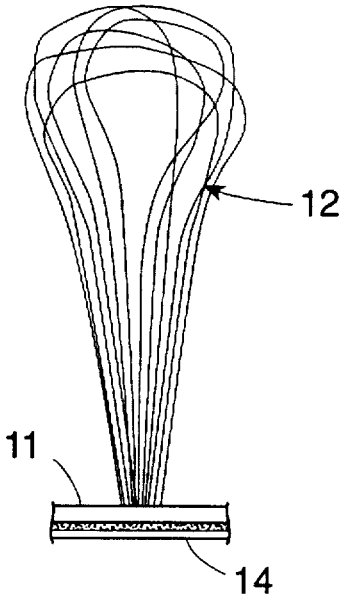
FIG. 3
FIG. 4
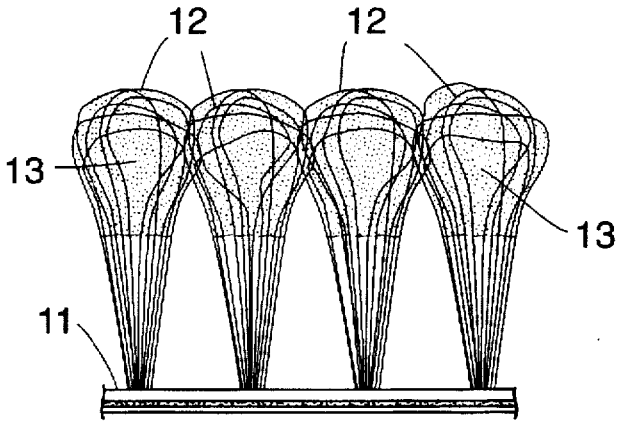

DISPOSABLE ORAL HYGIENE APPLICATOR

RELATED APPLICATION

This is application is a division of the prior application S.N. 08/604,125, now U.S. Pat. No. 5,678,273, filed Mar. 20, 1996 and entitled "DISPOSABLE ORAL HYGIENE APPLICATOR".

BACKGROUND OF INVENTION

1. Field of Invention:

This invention relates generally to oral hygiene implements for cleaning the teeth and massaging the gingival tissues in an oral cavity, and more particularly to a disposable oral hygiene applicator for this purpose which is adherable to a fingertip ball whereby the user's finger then functions as an articulated handle by which the applicator may be inserted in the oral cavity and applied omnidirectionally to sweep and clean the teeth and to massage the gums.

2. Status of Prior Art:

To maintain oral hygiene and prevent bacterial buildup causing plaque to form on the surface of the teeth which if not removed may result in periodontal disease, the teeth must be cleaned at regular and frequent intervals. And to maintain the gums in a healthy condition, the gums must be massaged and stimulated. To promote oral hygiene, it is customary to use a toothbrush for this purpose having a long, rigid plastic handle on one end of which is mounted a set of bristles to which a dentifrice in cream or powder form is applied.

When available, a conventional toothbrush is a satisfactory oral hygiene implement. However, there are many situations in public or private places away from home where a toothbrush and a dentifrice are not available. Thus while it is desirable after dining in a restaurant to then brush the teeth to remove food particles therefrom, it is usually inconvenient for an individual to carry a toothbrush his person. And it is a common occurrence for travelers and overnight guests to forget to bring along their own toothbrush as well as a tube of toothpaste. Yet one is ill advised to neglect oral hygiene even for a day, particularly after meals.

To make it possible for an individual to carry on his person a disposable and highly compact toothbrush and also a dentifrice sufficient for a single application, the prior art discloses various oral hygiene implements suitable for this purpose.

Thus the Jacobs U.S. Pat. No. 3,905,113, discloses a dental health tool in the form of a flexible, generally oval strip that is adherable to a fingertip, nylon bristles being mounted on the strip. Deposited on the oval strip between the bristles is a dry dentifrice. The bristles come in pairs, each pair being formed by a filament that is folded into a loop that extends through the base strip and is held in place by a lock strand at the underside of the strip that goes through the loop.

In the MacDonald U.S. Pat. No. 3,070,102, a disposable toothbrush is disclosed in which bristles are mounted on a flexible plastic base strip having an adherent coating thereon for attaching the base strip to a finger along its length, the bristles being smeared with toothpaste. This compact toothbrush is housed in a rupturable package formed of a plastic sheet onto which is marginally heat-sealed an aluminum foil sheet. The British patent to Fishman 2,122,482 discloses an applicator of generally rectangular shape, dimensioned to adhere to a corresponding rectangular area of the index finger of the user, the applicator having bristles thereon to function as a brush.

The Micciche U.S. Pat. No. 3,298,507 discloses an applicator having bristles in loop form clustered in a rectangular format a charge of dentifrice being entrapped therein. The Tunderman U.S. Pat. No. 3,902,509, shows a disposable device for cleaning teeth in the form of a thimble that slips over a finger, a polishing agent being adhered to the outer surface of the thimble which is rubbed over the surface of the teeth to remove food and plaque films therefrom.

Welker, U.S. Pat. No. 2,076,681, shows a dental cleaning and massage device in the form of a rubber cot that slips over a finger and is provided with bristles. In the McCord U.S. Pat. No. 3,952,867 the disposable applicator is in a thimble form that slips over finger.

SUMMARY OF INVENTION

In view of the foregoing, the main object of this invention is to provide a disposable oral hygiene applicator which is adherable to the ball of a fingertip, whereby the user's finger then functions as an articulated handle by which the applicator may be inserted in the oral cavity and applied to the teeth and to the gingival tissues to effect cleaning and massaging actions promoting oral hygiene without injury to the teeth or gums.

More particularly, an object of this invention is to provide a disposable oral hygiene applicator adapted to cover mainly the round ball of the fingertip, the applicator being formed by a circular base having anchored thereon a dense array of multi-strand filamentary loops serving as the soft bristles of an omnidirectional brush.

A significant advantage of the invention is that the multi-strand loops which constitute the bristles of the applicator create bulbs that serve to entrap a dentifrice in paste form embedded in the bulbs, so that the applicator incorporates therein sufficient dentifrice for a single treatment, after which the applicator is discarded, for it is no longer sterile. Because the looped bristles are in a circular array, they are capable of acting omnidirectionally in cleaning teeth and massaging gums, for regardless of the direction of the sweeping movement of the applicator with respect to the teeth and the gums, the applicator presents the same arcuate front. Moreover, because the multi-strand loops of the bristles function as scoops, they act to capture food particles and other debris, whereas cut bristles do not.

Also an object of the invention is to provide a highly compact package for a set of applicators, so that the package may be stored in a pocket, a wallet or elsewhere on the person of the user.

Yet another object of the invention is to provide a dispenser box containing a tape roll on which is adhered a train of applicators, each applicator being released from the tape when the tape is pulled out of the box.

Briefly stated, these objects are attained in a disposable oral hygiene applicator attachable to the ball of a user's fingertip whose finger then functions as an articulated handle by which the applicator may be inserted in the oral cavity and applied omnidirectionally to sweep and clean the teeth and to massage the gingival tissues.

The applicator includes a circular flexible base whose dimensioned to cover mainly the round ball of the fingertip, the underside of the base having a layer of pressure-sensitive adhesive thereon. Anchored on the base and projecting upwardly therefrom is a dense array of multi-strand filamentary loops viscous dentifrice being entrapped in the loops. In one preferred embodiment of the applicator adhering to the underside of the base is a removable carrier disc whose diameter exceeds that of the base to define a peripheral flange to facilitate removal of the disc so that the applicator may then be adhered to the fingertip.

BRIEF DESCRIPTION OF DRAWING

For a better understanding of the invention, as well as further features thereof, reference is made to the detailed description thereof to be read in connection with the annexed drawings wherein:

FIG. 1 is a top view of an oral hygiene applicator in accordance with the invention;

FIG. 2 is a side view of the applicator;

FIG. 3 is a greatly magnified view of a single bristle in the applicator;

FIG. 4 is a magnified side view of a row of bristles and the dentifrice embedded therein;

DESCRIPTION OF INVENTION

The Applicator

Figure 5:
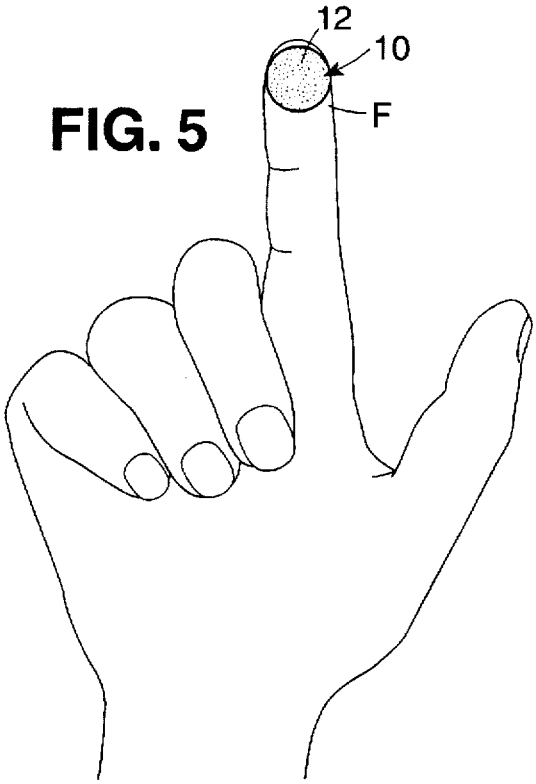
FIG. 5 illustrates the applicator attached to a fingertip ball of a user.

Referring now to FIGS. 1 to 4 illustrated in these figures is a single, oral hygiene applicator 10 in accordance with the invention. The applicator is disc-shaped so that it may be attached and conformed to the round ball of the fingertip of the user's index or forefinger. The diameter of the applicator is such that it covers mainly the round ball of the typical fingertip and not the rest of the fingertip. The applicator is therefore effectively a large dot and as such, is easily applied to the fingertip.

Dental hygiene applicator 10 is constituted by a flexible circular base 11 fabricated of woven nylon or other synthetic plastic or natural fibers on which is anchored a dense circular array of upwardly-projecting bristles 12. Each bristle 12, as best seen in FIG. 3 which shows the bristle in highly magnified form, is formed by a multi-strand loop created by fine filaments of nylon or similar material which are interwoven with base 11 to define a three-dimensional minute bulb. As shown in FIG. 4, imbedded in each bulb forming a bristle 12 is a dentifrice 13 in a viscous paste form which is entrapped within the strands that define the bulb.

Because bristles 12 are not constituted by individual cut filaments, as in a conventional toothbrush, but take the form of multi-strand loops, these loops have a dual advantage. The loops act to entrap the dentifrice so that it remains on the applicator until the applicator bristles are pressed against the teeth and the dentifrice is then extruded from the bristles. The loops also serve to prevent damage to the teeth surface, for the rounded ends of the strands while define the bulb of the loops are far less abrasive than the ends of cut filaments, even those having rounded ends. And since each bulb is formed by nylon filament strands having a diameter much finer than that of a conventional toothbrush nylon bristle, the applicator bristles are more flexible than those of a conventional tooth-brush and create a softer brush.

In practice, the dentifrice may include plaque control, tooth whitener, fluoride, medication and other ingredients useful in promoting oral hygiene. Because each applicator is stored in a sealed cell in a manner to be later described, the dentifrice embedded in the applicator is maintained in a sterile and usable state for a prolonged period.

Coated on the underside of base 11 of the applicator is a layer 11A of pressure-sensitive adhesive whose composition is such that it is insoluble in water and non-reactive with saliva so that the applicator remains attached to the finger when in the mouth.

The applicator, as shown in FIG. 5, is adhered and conforms to the round ball of a fingertip F of the user's finger. Because the applicator is disc-shaped, and the bristles thereon are in a dense circular array, and it is free of corners or other discontinuities and presents an arcuate front regardless of its direction of Movement. The applicator therefore functions on an omnidirectional brush, for regardless of how the applicator is positioned with respect to the teeth and gums, its bristles are always properly oriented. When applied to the teeth, the bristles snap into the crevices between teeth more readily than a conventional toothbrush in which the bristles are arranged in horizontal rows in a rectangular array.

Adhered to the underside adhesive layer 11A of the circular base 11 of the applicator, as shown in FIG. 1, is a removable liner in the form of a carrier disc 14 of a thin, transparent flexible film of synthetic plastic material, such as polyethylene or PVC. The diameter of disc 14 is somewhat greater than that of circular base 11 to define a peripheral flange 14F which facilitates the removal of the carrier disc to expose the pressure-sensitive adhesive layer so that the applicator can then be applied and conformed to the ball of the user's finger tip.

Operation of Applicator

Figure 6:
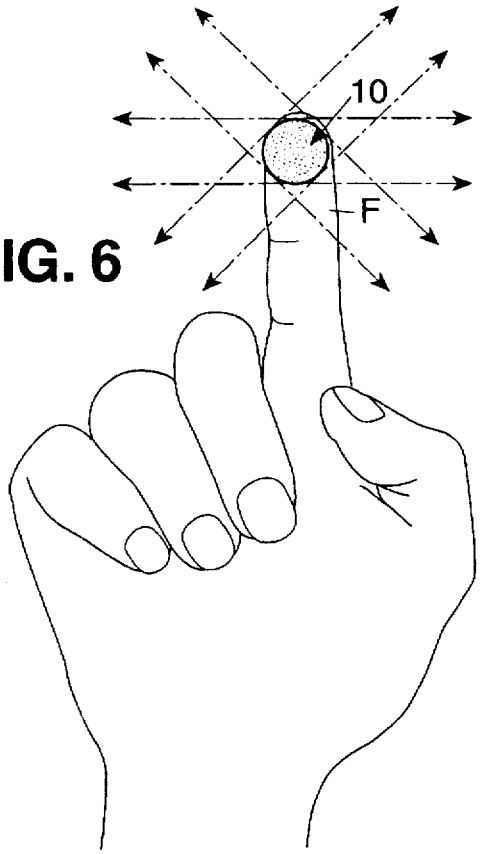
FIG. 6 illustrates the omnidirectional characteristics of the applicator.

Applicator 10, as shown in FIG. 5, is adhered and conforms to the round ball of a fingertip F of the user's index finger. Because the applicator is disc-shaped, and the bulbous bristles 12 thereon are in a dense circular array, the applicator is free of corners other discontinuities and presents an arcuate front regardless of its direction of movement. The applicator therefore functions as an omnidirectional brush, as shown in FIG. 6, that can be manipulated to sweep in any direction as indicated by the arrows. Regardless of how the applicator is positioned with respect to the teeth and gums, its bristles are always properly oriented. When applied to the teeth, the bristles snap into the crevices between teeth more readily than a conventional toothbrush in which the bristles are arranged in horizontal rows in a rectangular array.

Also, since the disc-shaped applicator is attached to a finger that functions effectively as an articulated handle, as contrasted to the stiff, unarticulated handle of a conventional toothbrush, the applicator may be applied to regions of the teeth and gums in the dental cavity which are otherwise difficult to reach with a conventional toothbrush. A finger has tactile sensitivity; hence when an applicator is attached to the ball of the fingertip, the finger can apply whatever pressure is necessary to effectively scrub the engaged dental surface. With a conventional handled toothbrush, this is not possible.

A finger ball is "the padded rounded underside of a human finger or toe near the tip" (Webster's Third New International dictionary). The dimensions of the circular base of an applicator in accordance with the invention are such as to mainly cover this round ball and not the rest of the fingertip. In practice, an applicator having a diameter of about ¾ of an inch will cover the typical rounded ball or a user's fingertip.

While no two users have fingertip balls of exactly the same size, an applicator in accordance with the invention is substantially confined to this round ball and its omnidirectional operating characteristics are based on this relationship. The fingertip is the most sensitive part of the finger, and with this fingertip one can manipulate the dental applicator attached to its ball to sweep over all front and rear surfaces of the teeth in any direction, far better than with a standard, rectangular toothbrush or with an applicator having a non-circular shape and therefore lacking in omnidirectional characteristics.

Utility

The usefulness of an applicator in accordance with the invention is not limited to those situations where the user lacks access to a regular toothbrush. Indeed, the applicator by reason of its omnidirectional characteristics and the fact that the articulated, tactilely-sensitive finger of the user serves as its handle, has distinct advantages over a conventional toothbrush, particularly in the case of pre-school children.

These children are taught by their parents that proper oral hygiene is important and therefore the teeth should be brushed vigorously at least twice every day. But a pre-school child finds it difficult to insert a toothbrush in his mouth without striking the wall of the dental cavity, and he finds it even more difficult to manipulate the toothbrush in a prescribed manner.

A recommended motion for brushing the teeth takes into account the orientation of the bristles on a conventional handled toothbrush, so that for an effective scrubbing action, the brush should be manipulated to sweep over the teeth surfaces in a circular orbit. This is not difficult for an adult to carry out, but a pre-school child has to be carefully taught how to manipulate a toothbrush. Because of the difficulties experienced in brushing with regular toothbrushes, many pre-school children tend to avoid brushing their teeth.

But with an omnidirectional applicator in accordance with the invention, a pre-school child will willingly adopt a proper approach to oral hygiene, for there is no need to first apply toothpaste to the brush (another problem), and the child has no difficulty in putting a finger in his mouth, and in fact may enjoy doing so, for this is an action he has practiced since babyhood.

And the child can then brush his teeth in any random way he pleases. He need not produce an orbital motion; for as long as the applicator sweeps across the teeth in any direction, as shown in FIG. 6, a cleansing action will take place. And, after the teeth have been cleaned, and the gums massaged, there is no need, as with a conventional toothbrush, to rinse the brush and put it back in a holder, for all the child need now to do is to detach the applicator from his finger and discard it. With a conventional toothbrush which is put to repeated use, it is important that the brush be maintained in sterile condition. But applicator 10 is disposable and a fresh applicator is used each time it is put to use.

Supply Package

Figure 7:
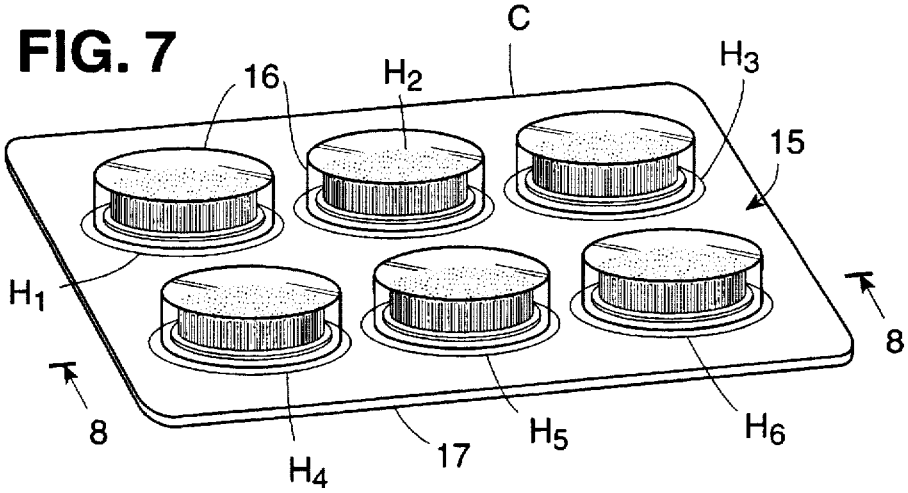
FIG. 7 is a perspective view of a supply package in a credit card format in accordance with the invention in which six applicators are stored in individual cells.
Figure 8:
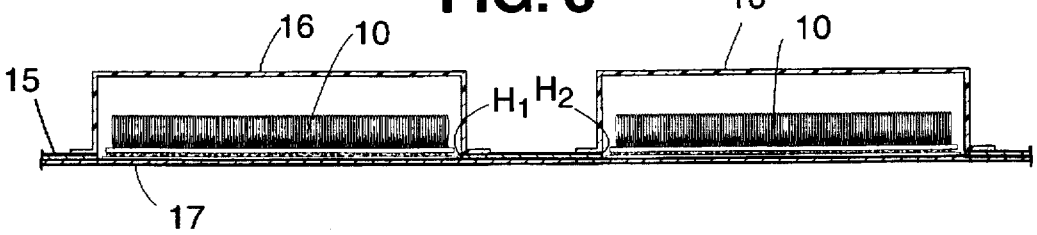
FIG. 8 is a longitudinal section taken in the plane indicated by line 8—8 in FIG. 7.

As shown in FIGS. 7 and 8, a compact supply package 15 in accordance with the invention is in a credit card format which serves to protectively store in sterile condition in individual cells, six oral hygiene applicators 10 of the type shown in FIG. 1. When the package is in the folded state illustrated in FIG. 9, the cells are sealed and it is not then possible to remove any applicator from the folder.

Package 15 includes a card C whose size is about the same as that of a standard credit card, card C being formed of cardboard or of a synthetic plastic material such as polyethylene or polycarbonate. Die-cut in card C is a rectangular array of six circular holes $H_1$ to $H_6$, each forming a cell to accommodate an applicator 10 of the type shown in FIG. 1. The diameter of the holes is slightly larger than that of the applicator carrier disc 14.

Overlying each card hole and enclosing the applicator nested in the cell is a flat-top circular dome 16 whose cylindrical use has a height slightly higher than that of the applicator covered by the dome. The domes overlying holes $H_1$ to $H_6$ and joined thereto are molded of transparent synthetic plastic film material, such as PVC, and while the domes are relatively rigid, they can easily be collapsed by applying finger pressure to their flat top.

Bonded to the underside of card C is a rectangular sheet 17 of aluminum foil whose dimensions match those of the card, the foil sheet sealing to seal the cells formed by holes $H_1$ to $H_6$.

Hence in order to remove a selected applicator 10 from its storage cell, the user has only to press the flat top of the collapsible plastic dome housing the selected cell to apply a sufficient downward pressure to the applicator housed therein to rupture aluminum foil sheet 17, in the region thereof which seals this applicator; thereby releasing the applicator from this cell.

When an applicator is removed from its cell, it is then necessary for the user to peel off carrier disc 14 which covers the pressure-sensitive adhesive layer 11A on the circular base 11 of the applicator, after which the applicator is adhered and conformed to the ball of a fingertip of the user, as shown in FIG. 5.

A package 15 in a credit card format, as shown in FIG. 7, takes little space and may be put in a jacket pocket or stored in a travel kit by a user so that is available wherever the user has occasion to brush his teeth away from home. But as pointed out previously, an applicator in accordance with the invention is not an emergency alternative to a standard toothbrush, to be put to use only when a toothbrush is not available, for many respects the applicator is superior to a toothbrush, because of its omnidirectional brushing characteristics and its ability to reach regions in the dental cavity are inaccessible to a handled toothbrush.

Figure 10:
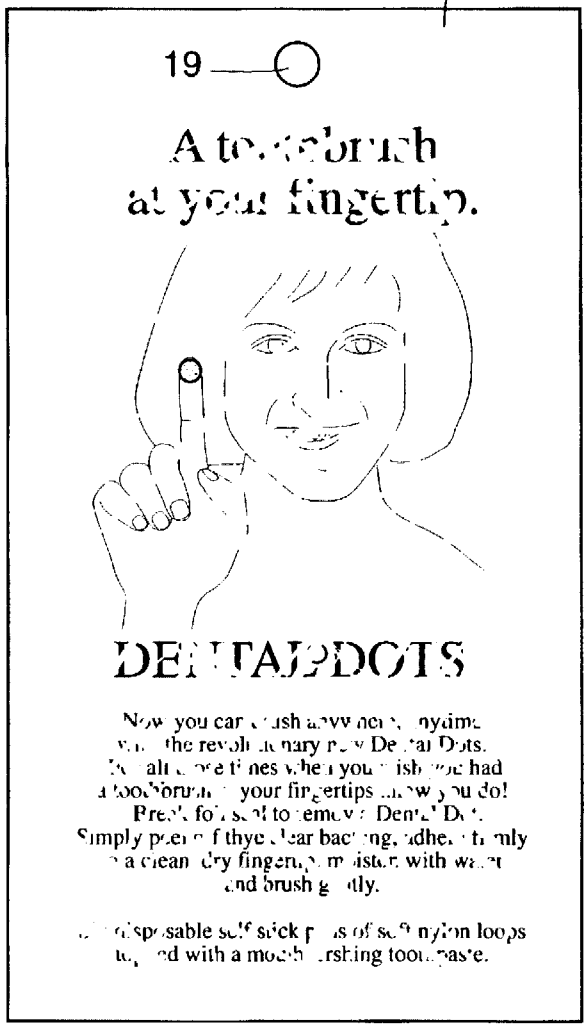
FIG. 10 is a rear view of the billfold.
Figure 9:
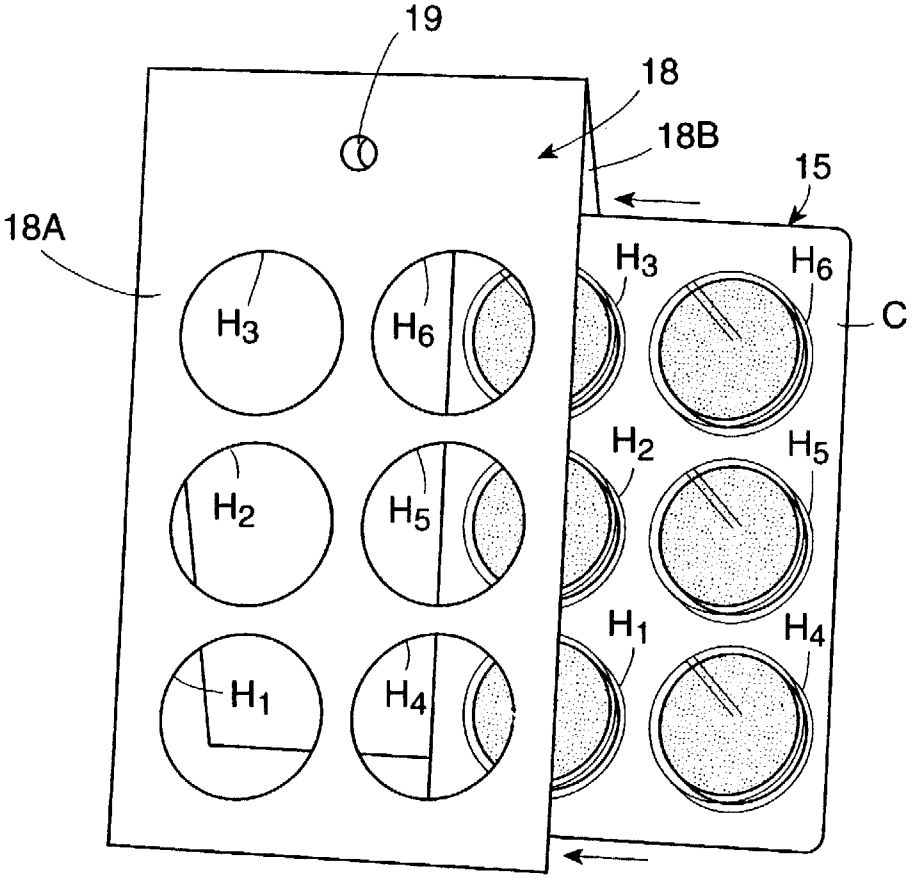
FIG. 9 is a perspective view of a billfold adapted to accommodate the package.

A preferred way of storing a credit card supply package 15 so that no applicator can be inadvertently released therefrom and the package may be put on display for sale is shown in FIGS. 9 and 10. In these figures it will be seen that supply package 15 (only the card C being shown) is inserted within a billfold-sized folder 18 formed of cardboard or other suitable material that can be die-cut and printed.

Folder 18 is formed from a rectangular sheet folded in half to define a face panel 18A and a rear panel 18B, these panels having the same width as that of the supply package 15 inserted therebetween, but a greater length.

Die-cut in face panel 18A is an array of holes $H_1$ to $H_6$ which register with the corresponding holes in supply package 15, so that when supply package 15 is inserted between the panels and is sandwiched therebetween, the domes 16 overly the holes $H_1$ to $H_6$ in package 15 project through the corresponding holes in the face panel 18A.

When supply package 15 is sandwiched between the face and rear panels of the folder, it is then in a security storage mode, for an applicator cannot be removed therefrom for package 15 is backed by rear panel 18B of the folder. Hence pressure applied to the dome of any applicator will be resisted by rear panel 18B and will not permit rupture of the aluminum foil 17 to release the applicator covered by the dome.

Rear panel 18B, as shown in FIG. 10, may be printed to illustrate how the applicator is to be applied to the ball of a fingertip of a user and to explain how with a toothbrush at your fingertip you can now brush your teeth and massage your gums.

The folder is also provided adjacent to fold line with a mounting hole 19 so that a stack of folders having packages 15 sandwiched therein may be suspended on a hook in a display counter or elsewhere.

Box Dispenser

FIGS. 11 to 14 show a box dispenser for storing and dispensing oral hygiene applicators 10 of the type shown in FIG. 1, except that in this dispenser omitted from the applicators is the removable carrier disc 14 which underlies the adhesive coated base 11.

In the box dispenser, the arrangement is such as to dispense only one applicator at a time so that it may be applied to the ball of the fingertip in the manner shown in FIG. 5; the box storing a large number of applicators.

Figure 13:
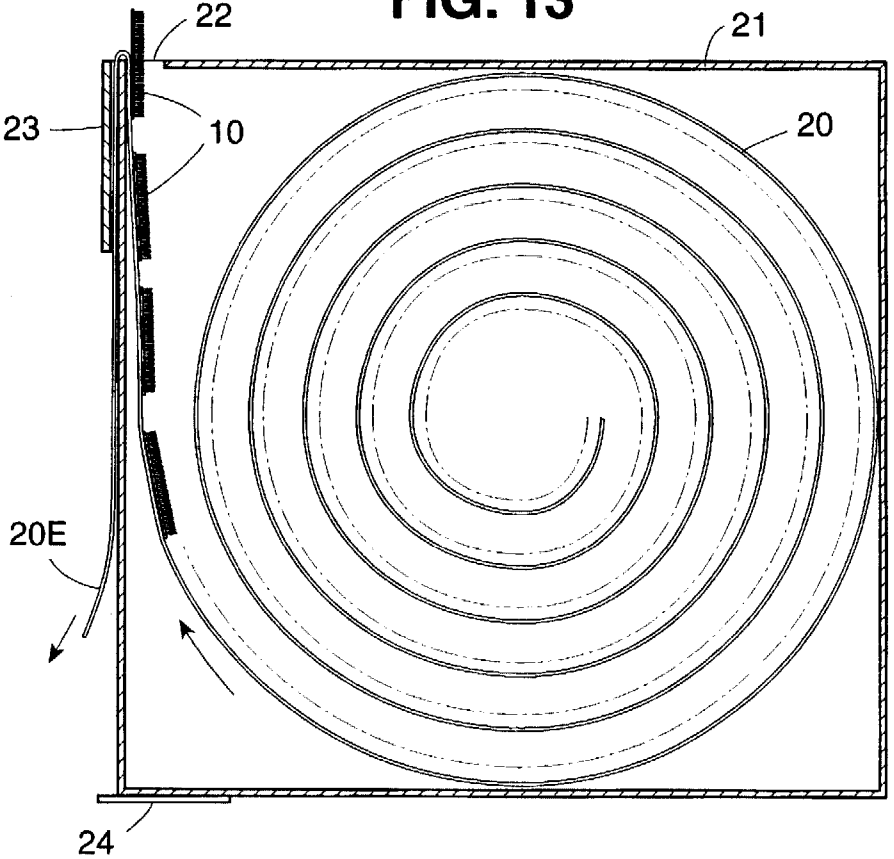
FIG. 13 shows the roll within the box.
Figure 14:
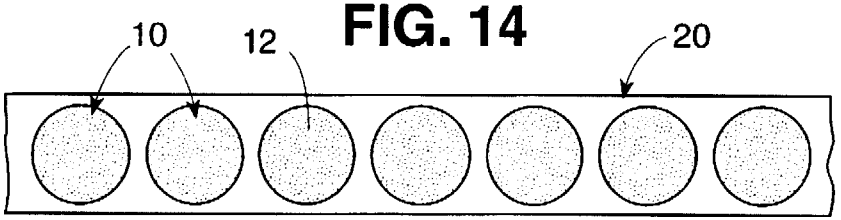
FIG. 14 is a top view of a portion of the tape.

In the box dispenser arrangement, a train of equispaced applicators 10 in which the underside of each applicator is coated with a layer 11A of pressure-sensitive adhesive is adhered to the face of a carrier in the form of a plastic film tape 20 as shown in FIG. 14. This tape, as illustrated in FIG. 13 is wound into a roll in which the train of applicators is carried on the outer surface of the tape, the roll being housed within a rectangular box 21 whose width is slightly greater than the width of the rolled tape so that the tape may be unrolled to release the applicators one at a time in the manner to be now explained.

Dispenser box 21 is provided at its upper left corner with an outlet slot 22 through which the leading end 20E of the tape emerges, the leading end 20E withdrawn from the box passes through a narrow side channel formed by a pocket 23 attached to the left side of the box. Hence the leading end 20E of the tape, as it goes upwardly through slot 22 then makes a sharp bend then downwardly to enter the side channel.

Secured to the bottom side of box 21 at the left side corner thereof is a cutting blade 24 formed of metal or plastic having a serrate cutting edge. Thus when the leading end 20E of the tape is pulled downward by a user through the side channel, the portion of the leading end which goes beyond the box may be severed by the blade 24 to leave a tail which can e used to again pull the tips out of the box.

Figure 11:
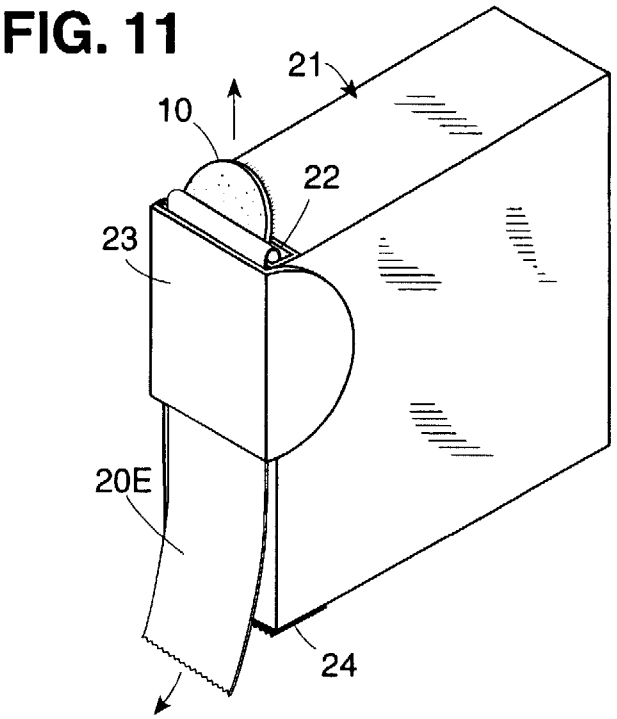
FIG. 11 is a perspective view of a dispenser box housing a rolled tape on which is mounted a train of applicators.
Figure 12:
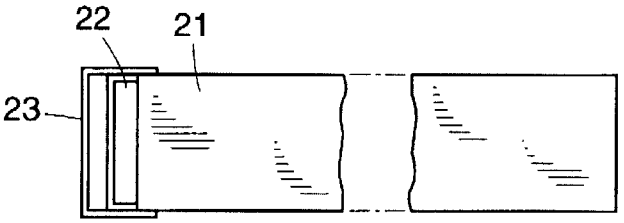
FIG. 12 is a top view of the box.

As shown in FIGS. 11 and 13, when leading end 20E of tape 20 carrying a train of applicators 10 which adhere to the outer surface of the rolled tape is pulled down through the side channel of the box, the applicators 10 and the tape in the roll they travel upward toward slot 22 in the box. But the applicator 10 in the roll which emerges from slot 22, as shown in FIG. 11, does not follow the sharp bend of the tape at the entry to the side channel, for the emerging applicator, as the tape reverses direction at the bend, then separates from the tape to which it is adhered so that it can be removed by the user.

Thus in operating the box dispenser, the user pulls the exposed leading end 20E of the tape to dispense a single applicator 10 so that it can be put to use, the applicators remaining on the roll within the box being held in reserve until the need arises for another applicator.

While there has been shown and described a preferred embodiment of a disposable oral hygiene applicator and a supply package therefor in accordance with the invention, it will be appreciated that many changes and modifications may be made therein without, however, departing from the essential spirit thereof.

I claim:

1. A supply package for storing a group of circular oral hygiene applicators, each adherable to a finger tip of a user; said package comprising:

A. a card having an array of holes therein, each forming a cell to accommodate a respective applicator of the group;

B. a metal foil sheet bonded to the underside of the card to close the cells; and C. a like array of collapsible domes joined to the upper side of the card to enclose the respective cells containing the applicators whereby a selected applicator can be released from the card by pressing and collapsing the dome enclosing the applicator to force the applicator to rupture the metal foil sheet.

2. A package as set forth in claim 1, in which the applicator is formed by a circular base having a circular array of filamentary loops anchored therein to function as a brush, the underside of the base being coated with a pressure sensitive adhesive to which is adhered a removable carrier disc, whereby when the applicator is in said cell, it does not adhere to said metal foil sheet.

3. A supply package as set forth in claim 1, in which the dome is formed of transparent flexible film material and has a flat top.

4. A supply package as set forth in claim 1, in which said card is die cut to form a rectangular array of six cell holes.

5. A supply package as set forth in claim 1, further provided with a folder having a front panel having an array of holes therein corresponding to the holes in the card, and a rear panel hinged to the front panel, said supply package being sandwiched between the front and rear panels of the folder, with the domes projecting through the holes in the front panel.

6. A supply package as set forth in claim 5, in which the folder is made of card board, and the outer surface of the rear panel is printed to provide instructions regarding the use of the applicator.

7. A supply package as set forth in claim 1, in which the card is in a credit card format and is made of synthetic plastic material die cut to form said holes.

* * * * *